US007113195B2

(12) United States Patent
Willis et al.

(10) Patent No.: US 7,113,195 B2
(45) Date of Patent: Sep. 26, 2006

(54) GENERATING PULSE WIDTH MODULATED WAVEFORMS TO DIGITALLY DRIVE PIXELS

(75) Inventors: Thomas E. Willis, Mountain View, CA (US); Michael O'Connor, Cupertino, CA (US)

(73) Assignee: Intel Corporation, Santa Clara, CA (US)

( * ) Notice: Subject to any disclaimer, the term of this patent is extended or adjusted under 35 U.S.C. 154(b) by 673 days.

(21) Appl. No.: 10/134,935

(22) Filed: Apr. 30, 2002

(65) Prior Publication Data

US 2003/0201986 A1 Oct. 30, 2003

(51) Int. Cl.
*G09G 5/10* (2006.01)

(52) U.S. Cl. ..... 345/691; 345/89; 348/756

(58) Field of Classification Search ..... 345/691, 345/692, 693, 204, 89; 348/755, 756, 770, 348/771, 750, 471
See application file for complete search history.

(56) References Cited

U.S. PATENT DOCUMENTS 4,524,345 A * 6/1985 Sybel et al. ..... 708/212
5,489,918 A * 2/1996 Mosier ..... 345/89
6,072,452 A * 6/2000 Worley et al. ..... 345/89
6,590,549 B1 * 7/2003 Marshall ..... 345/84
6,597,371 B1 * 7/2003 Mandl ..... 345/691
2002/0063728 A1 * 5/2002 Stevens ..... 345/690

* cited by examiner

*Primary Examiner*—Richard Hjerpe
*Assistant Examiner*—Kevin M. Nguyen
(74) *Attorney, Agent, or Firm*—Trop, Pruner & Hu, P.C.

(57) ABSTRACT

An array of display elements (e.g., pixels) in a display device (e.g., a spatial light modulator) may be digitally driven using pulse width modulated waveforms. Pulse width modulated waveforms may be locally generated to controllably drive each pixel in display systems with digital storage. A pixel drive circuit having a waveform generator may receive first digital data indicative of an optical output from an associated first display element. Moreover, second digital data indicative of a common reference with respect to a second display element may also be received at the first display element for comparison purposes. As a result, in one embodiment, a pulse width modulated waveform that includes only a single transition separating a first pulse interval and a second pulse interval may be generated based on a pixel value and a global count value instead of relying upon adding up multiple non-overlapping waveforms to drive a pixel.

30 Claims, 6 Drawing Sheets

GENERATING PULSE WIDTH MODULATED WAVEFORMS TO DIGITALLY DRIVE PIXELS

BACKGROUND

The present invention relates generally to electro-optical displays, and more particularly, to drive circuits with available digital storage for generating modulated waveforms, driving display elements of a display device.

An array of display elements (e.g., pixels) in a display device may be driven using drive signals, such as modulated waveforms. In doing so, each modulated waveform may individually drive a different pixel of the display device. There are many ways to generate these drive signals.

One approach involves using pulse width modulation (PWM) which is a well-known technique, having a host of applications including in display systems. By generating pulse width modulated waveforms, pixels with digital storage, such as in liquid crystal displays (LCDs) may be driven. For instance, a spatial light modulator (SLM) uses an electric field to modulate the orientation of a liquid crystal (LC) material. By the selective modulation of the LC material, an electronic display of an image may be produced on a screen, as the orientation of the LC material affects the intensity of light going through the LC material. Sandwiching of the LC material between an electrode and a transparent top plate, for example, may enable the modulation of the optical properties of the LC material. When the voltage applied across the electrode and the transparent top plate is changed, the LC material may produce different levels of output intensity, altering the image produced on the screen.

However, allowing a duty cycle of a drive signal to vary as a non-linear function of a pixel value within a refresh period may result in multiple "ON" pulses. Several existing PWM-based schemes for driving pixels rely on adding up non-overlapping waveforms to build a PWM waveform, causing undesirable multiple edges in the PWM waveform. Generation of such multiple-edged PWM waveform may fail to appropriately control the LC material. Unfortunately, while displaying an image, this lack of drive control may result in an inadequate control over optical outputs from pixels being driven. That is, this technique may produce undesired, multiple, intermediate sub-levels of intensity while transitioning between different desired levels of intensity.

Thus, there is a need for better ways to controllably drive display elements in display systems with available digital storage.

DETAILED DESCRIPTION

Figure 1:
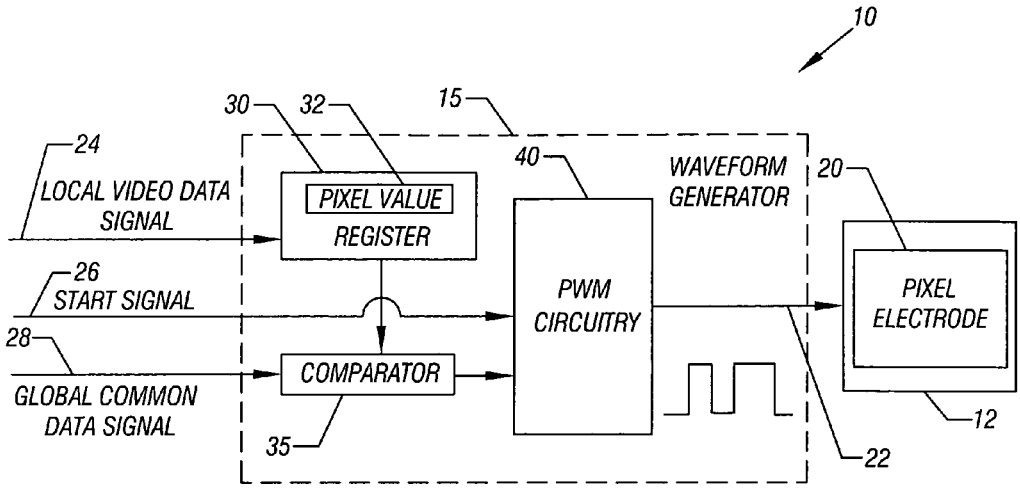
FIG. 1 is a block diagram of a pixel architecture with digital storage to generate a pulse-width modulation (PWM) waveform, in accordance with one embodiment of the present invention.

A pixel drive circuit 10 is shown in FIG. 1 with digital storage to enable generation of a pulse-width modulation (PWM) waveform, in accordance with one embodiment of the present invention. The pixel drive circuit 10 may be disposed proximate to a display element 12, such as a pixel. For example, in accordance with one embodiment the pixel drive circuit 10 may be advantageously located underneath the display element 12.

To controllably drive the display element 12, the pixel drive circuit 10 comprises a waveform generator 15 that is operably coupled to the display element 12. At the display element 12, associated digital information including a first and second digital data may be received from an appropriate source. In some embodiments, first digital data may be provided from a pixel source, storing video data as an example. Similarly, second digital data may also be provided from a counter in one case. For the purposes of receiving the first digital data, digital storage may be provided in the waveform generator 15.

Essentially, the pixel drive circuit 10 includes the waveform generator 15 to drive a pixel electrode 20 of the display element 12 in one embodiment. The pixel drive circuit 10 may comprise a storage element (e.g., a register) 30, a comparator 35, and PWM circuitry 40. For processing, the register 30 may retain the associated digital information including the first and second digital data.

Consistent with one embodiment, the waveform generator 15 may compare the first digital data with the second digital data. Based on this comparison, at least one transition may be selectively provided in a modulated signal 22, thereby directly, and digitally driving the display element 12. For example, a corresponding pixel value may be received in the register 30 through a local video data signal 24 and/or a global common reference may be received in the comparator 35 via a global common data signal 28.

One operation according to an embodiment of the present invention involves dynamically receiving the first digital data indicative of an optical output from the display element 12 at the waveform generator 15. The second digital data indicative of a common reference (e.g., a count value) with respect to another display element (not shown, although similar to the display element 12) may be received as well. Depending upon on a particular set of the first and second digital data, the modulated signal 22 (e.g., a PWM waveform) is generated with one transition separating a first pulse interval from a second pulse interval for the display element 12.

More specifically, the waveform generator 15 may derive a single transition to form the modulated signal 22 within a refresh period. Instead of relying upon addition of multiple non-overlapping waveforms for building a PWM waveform, the display element 12, in turn, may be illuminated for a desired duration based on the single transition in the modulated signal 22 within the refresh period.

When the first digital data is compared to the second digital data by the comparator 35, as a result, an indication of a comparison between the first and second digital data may determine the timing or location of the single transition. To provide an optical output, i.e., produce different levels of intensities based on this comparison, the display element 12 may be driven from the modulated signal 22 accordingly.

In one embodiment, the display element 12 may belong to a light modulator, such as a spatial light modulator (SLM) including a plurality of pixels. Using an array of the pixel drive circuit 10, an SLM device (for example, a display device with a liquid crystal material (LC)) may be driven by electronics located under each pixel. Such pixel architecture may enable a direct digital driving of the SLM device.

Of course, there are many reasonable pixel architectures for these devices, each of which have implications on how the LC material is driven. For example, a digital pixel architecture may store a color value under the pixel in a digital fashion. This enables the pixel architectures that use pulse-width modulation to produce color in SLM devices. In this approach, the LC material is driven by a signal PWM waveform where "ON" time is a function of the desired color value.

Figure 2:
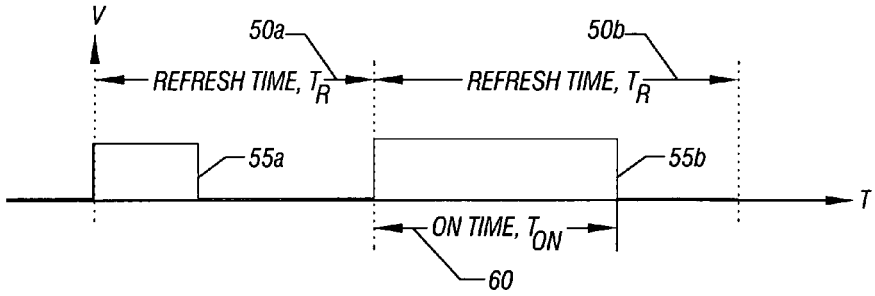
FIG. 2 is a hypothetical graph of applied voltage versus time for a spatial light modulator (SLM) in accordance with one embodiment of the present invention.

A hypothetical graph of applied voltage versus time (e.g., a drive signal, a PWM waveform) for a display device (e.g., a spatial light modulator (SLM)) is shown in FIG. 2 in accordance with one embodiment of the present invention. Within a first refresh time period, $T_R$, 50*a*, the drive signal including a first transition 55*a* and during the next cycle, i.e., within a second refresh time period, $T_R$, 50*b*, the drive signal including a second transition 55*b* may be applied to the pixel electrode 20 of FIG. 1, for example. Each of the first and second transitions 55*a*, 55*b*, separates the drive signal in first and second pulse intervals. The first pulse interval of the second refresh time period 50*b* is indicated as the "ON" time, $T_{on}$ 60, as an example.

In some embodiments, the "ON" time, $T_{on}$ 60, of the drive signal of FIG. 2 is a function, $f_{pwm}$, of the current pixel value, p, where $p \in [0, 2^n-1]$, n is the number of bits in a color component (typically 8 for some display systems), $T_{on} \in [0, T_R]$, and $T_R$ is a constant refresh time. The first and second refresh time periods, i.e., $T_R$, 50*a* and 50*b*, may be determined depending upon the response time, i.e., $T_{resp}$, of the liquid crystal (LC) material along with an update rate, i.e., $T_{update}$, (e.g., the frame rate) of the content that the display element 12 (FIG. 1) may display when appropriately driven.

Ideally, the refresh time periods, i.e., $T_R$, 50*a* and 50*b* may be devised to be shorter than that of the update rate, $T_{update}$, of the content, and the minimum "ON" time, minimum ($T_{on}$), may be devised to be larger than the response time, $T_{resp}$, of the LC material. However, $T_{on}$ 60, may be time varying as a pixel value "p" may change over time. It is often desirable to use a non-linear function for $f_{pwm}$ to match this function with other non-linear aspects of the display element 12. The function $f_{pwm}$ may be realized through a variety of conventional hardware.

Figure 3A:
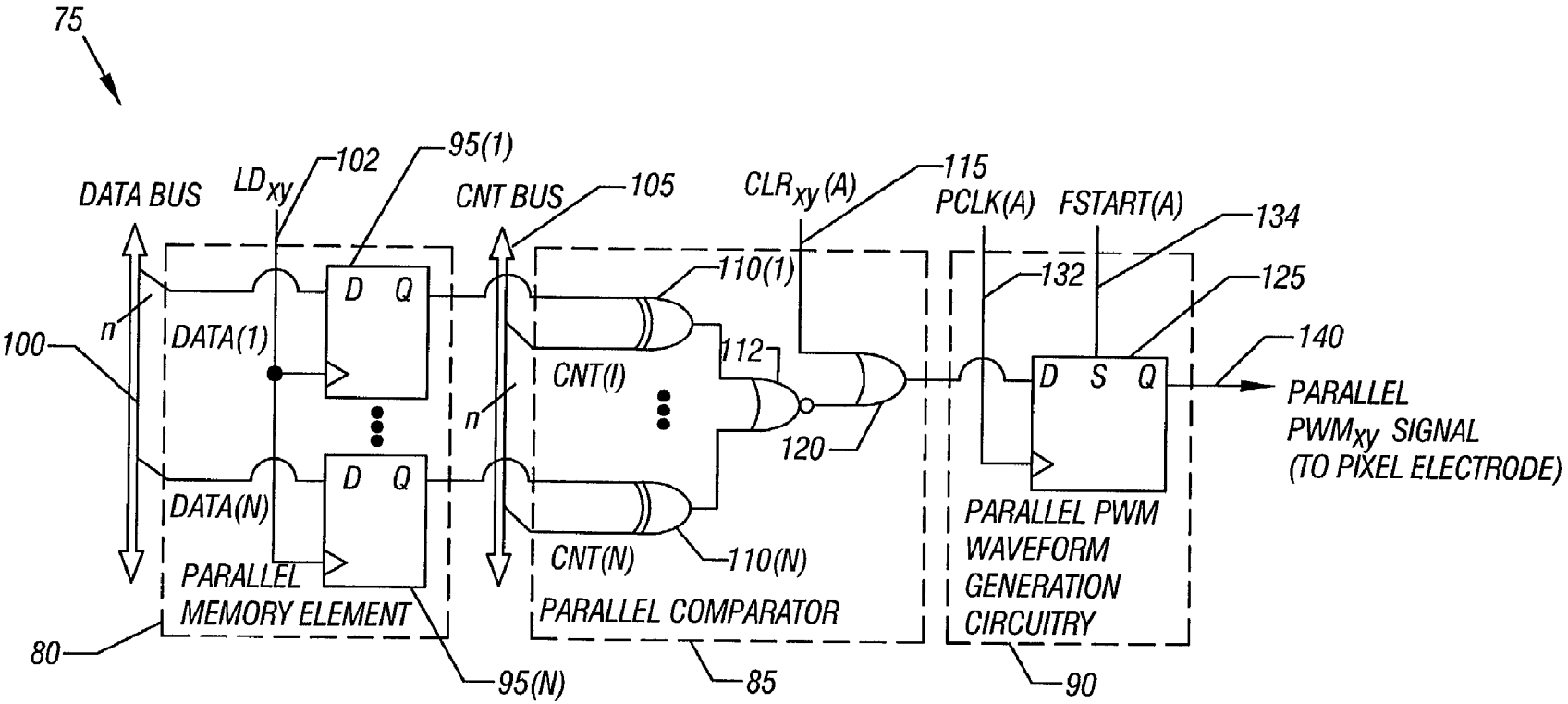
FIG. 3A is a schematic depiction of a parallel per-pixel signal generator with digital storage employing pulse-width modulation in a parallel configuration according to an embodiment of the present invention.

For a display element, a parallel per-pixel signal generator 75 with digital storage shown in FIG. 3A employs pulse-width modulation in a parallel configuration according to an embodiment of the present invention. In the illustrated embodiment, the parallel per-pixel signal generator 75 may comprise a parallel memory element 80, a parallel comparator 85 and parallel PWM waveform generation circuitry 90.

Although color components of two bits are considered, the color components with more bits can be incorporated with appropriate modifications. Therefore, the scope of the present invention is not limited in this respect. For a display comprising a plurality of display elements (i.e., pixels) forming an array of display elements in a liquid crystal display, the parallel per-pixel signal generator 75 may be suitably coupled underneath or proximate to each display element. According to one embodiment, the liquid crystal display may be a spatial light modulator. When discussing signals in the following sections, a subscript "xy" is used to identify a signal that is specific to a given pixel in a pixel array.

In operation, the parallel PWM waveform generation circuitry 90 may receive a signal based on an indication from the parallel comparison, causing the one transition from the "ON" logic state to the "OFF" logic state when the first and second digital data are substantially equal. On the other hand, when the first and second digital data are significantly different, another signal based on an indication from the parallel comparison may cause one transition from the "OFF" logic state to the "ON" logic state.

Each pixel compares the value in an under-pixel storage with the current counter value to determine how to update the pulse width modulated signal. This comparison is performed on all bits in parallel. Data is also loaded into the pixel in parallel. While only a basic configuration is presented, several variations on this basic configuration are possible. Pixel hardware in an embodiment with the parallel comparison, for example, may provide two bits of storage for each pixel associated with the parallel per-pixel signal generator 75.

To digitally store bits of data, the parallel memory element 80 may include at least one register having one or more flip-flops 95(l) through 95(N), i.e., depending upon the number of data bits, as an example. In some embodiments, the parallel memory element 80 may receive in parallel first digital data including a current pixel value over a "DATA" bus 100 which may be n-bits wide (i.e., "n" being the width of first digital data in number of bits). More particularly, each flip-flop 95 may receive a corresponding one data bit of an n-bit wide first digital data DATA(l) through DATA(N) over the "DATA" bus 100. A load signal "$LD_{xy}$" 102 may enable loading the first digital data (e.g., current pixel data) into the parallel memory element 80.

Likewise, a count "CNT" bus 105 may receive in parallel second digital data including a current count value at the display element. The parallel comparator 85 may include one or more exclusive-or (XOR) gates 110(l) through 110 (N) depending upon the number of count bits. Each XOR gate 110 may receive a corresponding one count bit of an n-bit wide second digital data CNT(l) through CNT(N) over the count "CNT" bus 105, in one case. Outputs of the XOR gates 110(l) through 110(N) may be fed to a NOR gate 112 and further combined with a clear signal "$CLR_{xy}$ (A)" 115 at an OR gate 120 to output a result of a parallel comparison to the parallel PWM waveform generation circuitry 90.

The parallel PWM waveform generation circuitry 90 may comprise a storage element to form a modulated signal based on one transition responsive to the parallel comparison. However, the storage element in the parallel PWM waveform generation circuitry 90 may be a dynamic element, i.e., a D flip-flop 125 as it may not have to hold a stored value for a duration longer than the refresh period. A frame start signal "FSTART (A)" 134 may be applied to the D flip-flop 125 for indicating a beginning of each refresh period. Similarly, a clock signal "PCLK (A)" 132 may be applied to the D flip-flop 125 to indicate when a counter providing the second digital data changes its value.

In operation, the parallel PWM waveform generation circuitry 90, in turn, may perform pulse width modulation based on the parallel comparison of the current pixel value and the current count value to indicate the location or timing of the one transition within a parallel $PWM_{xy}$ signal 140 being furnished by the parallel PWM waveform generation circuitry 90.

Consistent with one embodiment of the present invention, the parallel PWM waveform generation circuitry 90 may receive the frame start signal "FSTART (A)" 134 to start a frame within a refresh period and set the parallel $PWM_{xy}$ signal 140 to an "ON" logic state at the beginning of the frame. The load signal "$LD_{xy}$," 102 may be received to selectively load the current pixel value at a particular display element while the current count value may be dynamically updated.

As described above, drive control signals in one implementation include two bits where "n" being the number of color component bits. In particular, signals DATA(l) and DATA(N) on the n-bit "DATA" bus 100 each provide the current pixel value for loading into a respective pixel. The signal "$LD_{xy}$," 102 is "ON" an active transition, and loads the value on the "DATA" bus 100 into the respective pixel. Signals CNT(l) and CNT(N) on the n-bit "CNT" bus 105 each provide the current count value to compare with the current pixel value at a corresponding pixel. The signal "$CLR_{xy}$ (A) "115" forces the parallel PWM waveform generation circuitry 90 to set its output low. The signal "FSTART (A)" 134 may be asserted at the beginning of each refresh period to set the parallel PWM waveform generation circuitry 90 output high. The signal "PCLK (A)" 132 is clocked based on a change in the current count value. This signal causes the parallel PWM waveform generation circuitry 90 to update its state as appropriate (e.g., set it low if the current count and pixel values are equal).

In some embodiments, local video data is loaded into in the parallel memory element 80 by placing the data on the "DATA" bus 100 and asserting the "$LD_{xy}$," 102 signal. The parallel comparator 85 compares a global count value, with a local pixel value within the parallel memory element 80. When these values are determined to be equal, a reset signal is asserted on the parallel memory element 80, and in turn, the parallel $PWM_{xy}$ signal 140 transitions to a low state. This signal remains in the low state until the "FSTART (A)" 134 signal is asserted back to start an another cycle.

The parallel $PWM_{xy}$ signal 140 drives the liquid crystal (LC) material of an LCD pixel with a drive signal having a duty cycle proportional to the local pixel value. The "$CLR_{xy}$ (A)" 115 signal allows external hardware to set the parallel $PWM_{xy}$ signal 140 to zero at a desired point in time. When writing a value "p" into the LCD pixel, such that "p"<"c" where "c" is the global count value, parallel $PWM_{xy}$ signal 140 may be turned off. The "$CLR_{xy}$ (A)" 115 signal facilitates this behavior.

Alternatively, this comparison may be performed externally to the LCD pixel, as it may not depend on the local pixel value. The "$LD_{xy}$," 102 and "$CLR_{xy}$ (A)" 115 signals may be qualified by row and column enables in order to allow them to apply to a particular LCD pixel within an array of LCD pixels. The hardware to perform this qualification (e.g., row and column enables) is not shown.

Numerous variations are possible for the parallel per-pixel signal generator 75. Some of the variations include changes to the parallel comparator 85 that performs a parallel comparison between the first and second data (e.g., data A and B), "B>A?" rather than "B=A?" as is done in the illustrated embodiment).

Additionally, or alternatively, the "$CLR_{xy}$ (A)" 115 signal may be advantageously eliminated including the OR gate 120 it drives. With this implementation, the parallel comparator 85 ensures that the parallel $PWM_{xy}$ signal 140 is cleared properly when writing a value into a pixel that is lower than the count. Otherwise, it may be possible to get the D flip flop 125 to provide an appropriate alternating biasing signal for the LC material without using an external XOR gate. Other embodiments may also be devised by changing the column drive scheme.

Alternatively, in another embodiment, while serially receiving first digital data including a current pixel value in at least one register associated with a display element, the second digital data including a current count value may be received serially as well. Furthermore, pulse width modulation may be performed based on a serial comparison of the current pixel and count values to indicate a single transition in a modulated signal.

In this embodiment, a first port serially receives the first digital data including the current pixel value in at least one register associated with a display element. To serially receive the second digital data including a current count value at the display element, a second port may be provided. For serially forming the modulated signal based on a single transition, circuitry may further be included to perform pulse width modulation based on a serial comparison of the current pixel and count values.

Figure 3B:
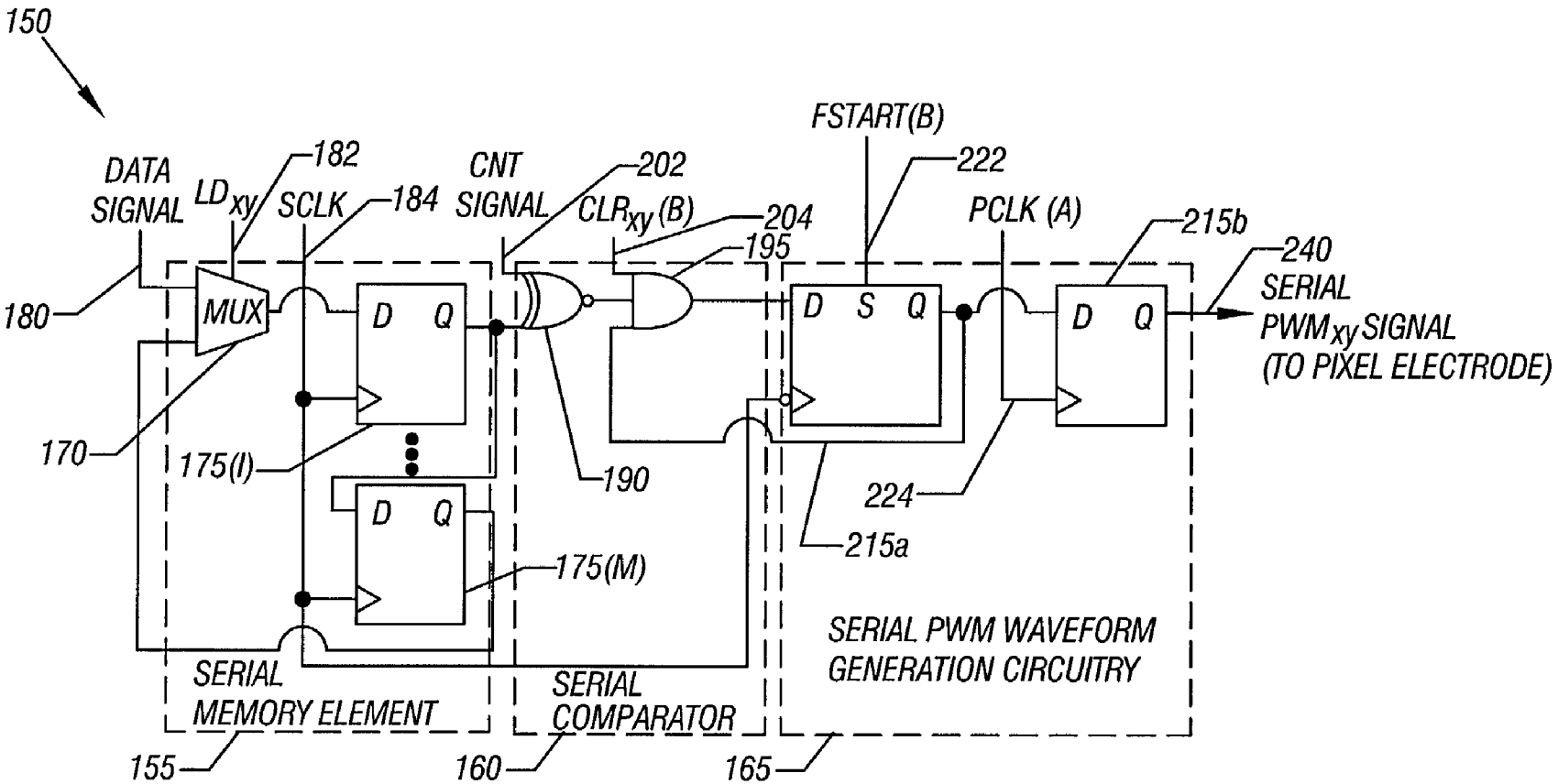
FIG. 3B is a schematic depiction of a serial per-pixel signal generator with digital storage employing pulse-width modulation in a serial configuration, according to an alternate embodiment of the present invention.

For a display element, a serial per-pixel signal generator 150 with digital storage shown in FIG. 3B employs pulse width modulation in a serial configuration according to an alternate embodiment of the present invention. As shown, the serial per-pixel signal generator 150 may comprise a serial memory element 155, a serial comparator 160 and serial PWM waveform generation circuitry 165. To digitally receive and store bits of data, the serial memory element 155 may include a multiplexer (MUX) 170 and at least one register having one or more flip-flops 175(l) through 175(N), i.e., depending upon the number of data bits, as an example.

For loading data into a pixel, the data may be aligned to agree with the current state of the pixels. Given that the pixels shift in unison, this state is the same for all pixels. Thus, the alignment may be implemented with a shift register or a shifter (e.g., a barrel shifter) or any another similar structure that modifies a pixel value before it is sent to the pixel array. Typically, the data may be loaded in the time it takes for a single bit to be compared.

Here, a comparison between the current pixel and count values may be serially performed. To accomplish this, the n-bit register that stores the current pixel value may be organized as a shift register. By connecting the most significant bit (MSB) and least significant bit (LSB) in the shift register, it may be possible to preserve the current pixel value in the shift register.

Next, the n-bits of the current count bit may be provided to each pixel serially and compared with the corresponding bit in the current pixel value. If after examining all n-bits, no differences are found (i.e., the current count and pixel values are equal), the PWM circuitry turns off its output. When a current count value is available for a time "t," the shift register ideally is clocked with a period of at most "t/n."

In some embodiments, the serial memory element 155 may serially receive first digital data including a current pixel value over a "DATA" signal 180. The current pixel value may be n-bits long (i.e., "n" being the length of first digital data in number of bits). A load signal "$LD_{xy}$" 182 may enable loading of the first digital data (e.g., current pixel data) into the MUX 170.

The serial comparator 160 may comprise an exclusive-nor (XNOR) gate 190 operably coupled to an OR gate 195. A count "CNT" signal 202 may serially furnish the second digital data including a current count value to the serial comparator 160 at the XNOR gate 190. The output of the XNOR gate 190 may be fed to the OR gate 195 and further combined with a clear signal "$CLR_{xy}$ (B)" 204 to output a result of a serial comparison to the serial PWM waveform generation circuitry 165.

The serial PWM waveform generation circuitry 165 may comprise storage elements to form a modulated signal based on a single transition in response to the serial comparison. A first storage element in the parallel PWM waveform generation circuitry 165 may be a first D flip-flop 215*a* feeding a second storage element, i.e., a second D flip-flop 215*b*. As these storage elements may not have to hold a stored value for a duration longer than the refresh period, dynamic elements, such as flip-flops may be deployed.

In operation, a frame start signal "FSTART (B)" 222 may be applied to the first D flip-flop 215*a* for indicating a beginning of each refresh period. A clock signal "PCLK (B)" 224 may be applied to the second D flip-flop 215*b*, for example, as a counter changes its count value. As a result, a serial $PWM_{xy}$ signal 240 may be generated that controllably drives the pixel electrode 20 (FIG. 1).

Again depending upon a particular application, as described above in the context of the parallel embodiment, many variations of this serial embodiment are possible.

Some variations may include appropriately modifying the comparison circuitry in FIG. 3B to perform "B>A?" instead of "B=A". With this implementation, the comparison circuitry ensures that the serial $PWM_{xy}$ signal 240 is cleared properly when writing a value into a pixel that is lower than the current count where it may be desired that the comparison proceed from the MSB to LSB. Another variation involves additional hardware to load the pixel value in a parallel fashion rather than serially.

While the parallel embodiment of FIG. 3A examines the data in one, 8-bit wide chunk, the serial embodiment of FIG. 3B examines the data in eight, 1-bit wide chunks. Therefore, another embodiment of the present invention may be based on a combination of the previous two (parallel and serial) embodiments, performing a serial-parallel comparison. In this case, the comparison may be done in parallel over portions of the pixel value that are loaded serially. For example, with an 8-bit pixel value, the data could be examined in four, 2-bit wide chunks.

Figure 4A:
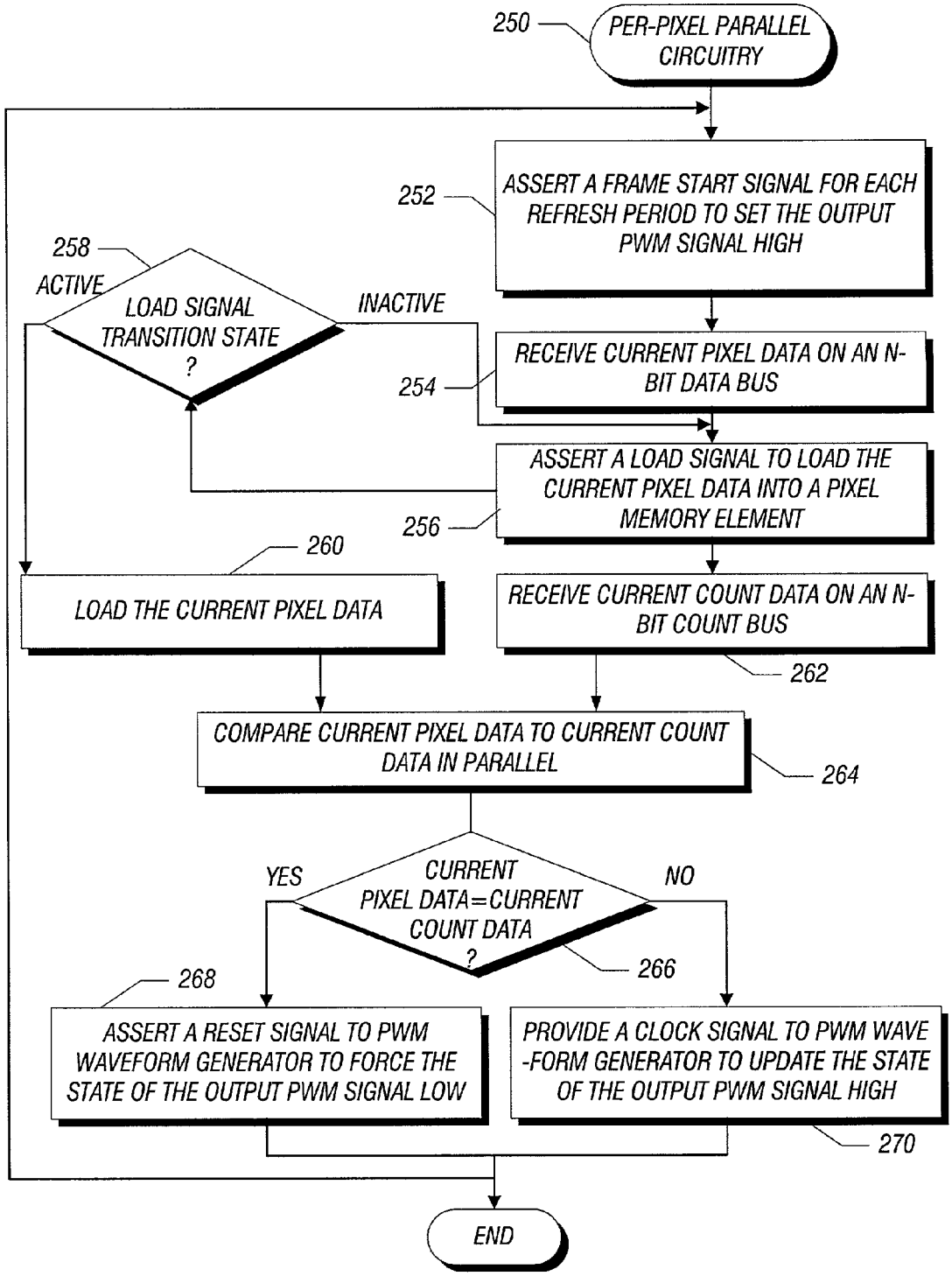
FIG. 4A is a flow chart of a per-pixel parallel circuitry to digitally drive pixels from pulse width modulated waveforms in accordance with one embodiment of the present invention.

Referring to FIG. 4A, per-pixel parallel circuitry 250 may digitally drive a pixel from a pulse width modulated waveform in accordance with one embodiment of the present invention. To set the output of the parallel per-pixel signal generator 75 (FIG. 3A), i.e., the parallel $PWM_{xy}$ signal 140 to a high state (e.g., a digital logic level "1"), a frame start signal (e.g., the "FSTART (A)" 134 of FIG. 3A) maybe asserted for each refresh period at block 252. On the n-bit "DATA" bus 100 of FIG. 3A, first digital data (e.g., current pixel data) may be received at block 254. When asserted, the load signal "$LD_{xy}$" 102 of FIG. 3A may enable loading the current pixel data into a pixel, i.e., in the parallel memory element 80 of FIG. 3A associated with the pixel, at block 256.

A check at diamond 258 may ascertain the state of the load signal "$LD_{xy}$" 102. That is, the per-pixel parallel circuitry 250 may determine whether the load signal "$LD_{xy}$" 102 is in an active or inactive transition state. When the transition state is determined to inactive, the per-pixel parallel circuitry 250 may wait for the load signal "$LD_{xy}$" 102 to be asserted, i.e., for the transition state to become active. Conversely, if the transition state is determined to be active, the first digital data (e.g., current pixel data) may be loaded at block 260. Second digital data (e.g., current count data) may be received on the n-bit count "CNT" bus 105 of FIG. 3A at block 262.

At block 264, using the parallel comparator 85 of FIG. 3A, the current pixel data may be compared in a parallel fashion to the current count data. If the current pixel data is determined to be substantially same as that the current count data, at diamond 266, a reset signal (e.g., the clear signal "$CLR_{xy}$ (A)" 115 of FIG. 3A) is asserted to the parallel PWM waveform generator circuitry 90 of FIG. 3A in block 268. This forces the state of the output from the parallel PWM waveform generator circuitry 90, i.e., the parallel $PWM_{xy}$ signal 140 to a low state (e.g., a digital logic level "0"). Otherwise, a clock signal (e.g., the signal "PCLK (A)" 132 of FIG. 3A) may be provided to the parallel PWM waveform generator circuitry 90 for updating the state of the parallel $PWM_{xy}$ signal 140 to a high state (e.g., a digital logic level "1") at block 270. Accordingly, for each refresh period, the per-pixel parallel circuitry 250 may iteratively follow this routine in accordance with one embodiment of the present invention.

Figure 4B:
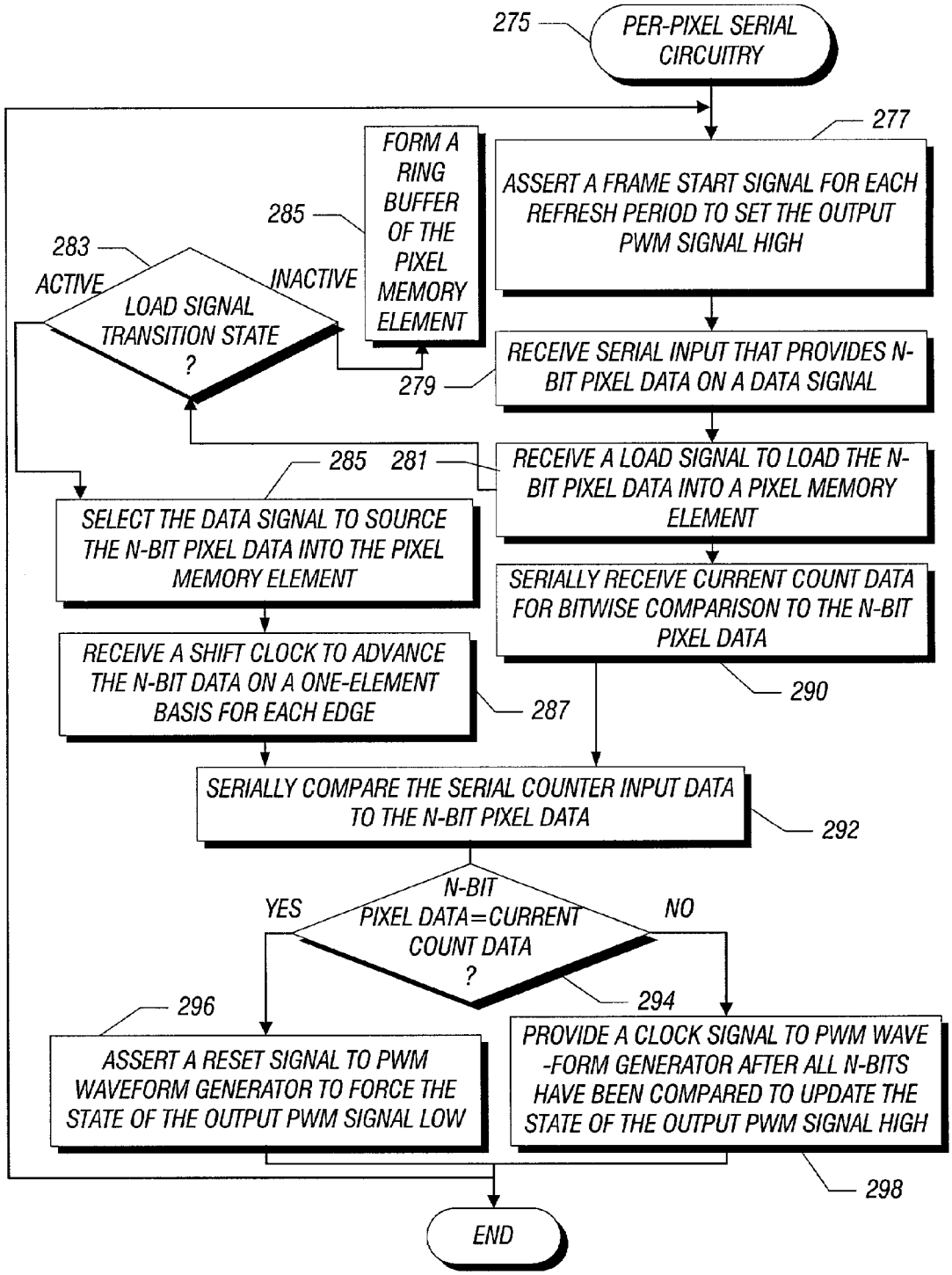
FIG. 4B is a flow chart of a per pixel serial circuitry to digitally drive pixels from pulse width modulated waveforms in accordance with another embodiment of the present invention.

Turning now to FIG. 4B, per-pixel serial circuitry 275 may digitally drive a pixel from a pulse width modulated waveform in accordance with one embodiment of the present invention. To set the output of the serial per-pixel signal generator 150 (FIG. 3B), i.e., the serial $PWM_{xy}$ signal 240 to a high state (e.g., a digital logic level "1"), a frame start signal (e.g., the "FSTART (B)" 222 of FIG. 3B) may be asserted for each refresh period at block 277. Over the digital data signal 180 of FIG. 3B, n-bit pixel data (e.g., current pixel data) may be serially received at block 279. When asserted, the load signal "$LD_{xy}$" 182 of FIG. 3B may enable loading the current pixel data into a pixel, i.e., in the serial memory element 155 of FIG. 3B associated with the pixel, at block 281.

A check at diamond 283 may ascertain the state of the load signal "$LD_{xy}$" 182. That is, the per-pixel serial circuitry 275 may determine whether the load signal "$LD_{xy}$" 182 is in an active or inactive transition state. If determined to inactive, a ring buffer may be formed of the serial memory element 155. Alternatively, if the transition state is determined to be active, the data signal 180 may be selected for furnishing the first digital data (e.g., current n-bit pixel data) into the serial memory element 155 at block 285. At block 290, second digital data (e.g., current count data) may be serially received on the count signal "CNT" 202 of FIG. 3B at the serial comparator 160 in order to enable a bitwise comparison with the current n-bit pixel data.

As shown in FIG. 3B, the shift clock 184 may be provided to the flip-flops 175(l) through 175(M) at block 287 for the purposes of advancing the current n-bit pixel data on a one-element basis corresponding to each edge in one embodiment. Then the current n-bit pixel data may be compared to the serially received current count data in a serial manner by the serial comparator 160 of FIG. 3B at block 292.

If the current n-bit pixel data is determined to be substantially same as that the current count data, at diamond 294, a reset signal (e.g., the clear signal "$CLR_{xy}$ (B)" 204 of FIG. 3B) is asserted to the serial comparator 160 in block 296. This forces the state of the output from the serial PWM waveform generator circuitry 165, i.e., the serial $PWM_{xy}$ signal 240 driving a pixel electrode to a low state (e.g., a digital logic level "0").

Otherwise, a clock signal (e.g., the signal "PCLK (B)" 224 of FIG. 3B) may be provided to the serial PWM waveform generator circuitry 160 after all n-bits have been compared for updating the state of the serial $PWM_{xy}$ signal 240 to a high state (e.g., a digital logic level "1") at block 298. In this way, for each refresh period, the per-pixel serial circuitry 275 may run this routine iteratively according to one embodiment of the present invention.

A processor-based system may comprise a plurality of pixel cells forming a pixel array being driven by a plurality of local drive circuits. Each local drive circuit may be associated with a different pixel cell of the pixel array to receive pixel video data indicative of an optical output from a different pixel cell and receive a dynamically changing count data being shared by the plurality of pixel cells. For each different pixel cell, a single-edged PWM waveform may be generated.

Figure 5:
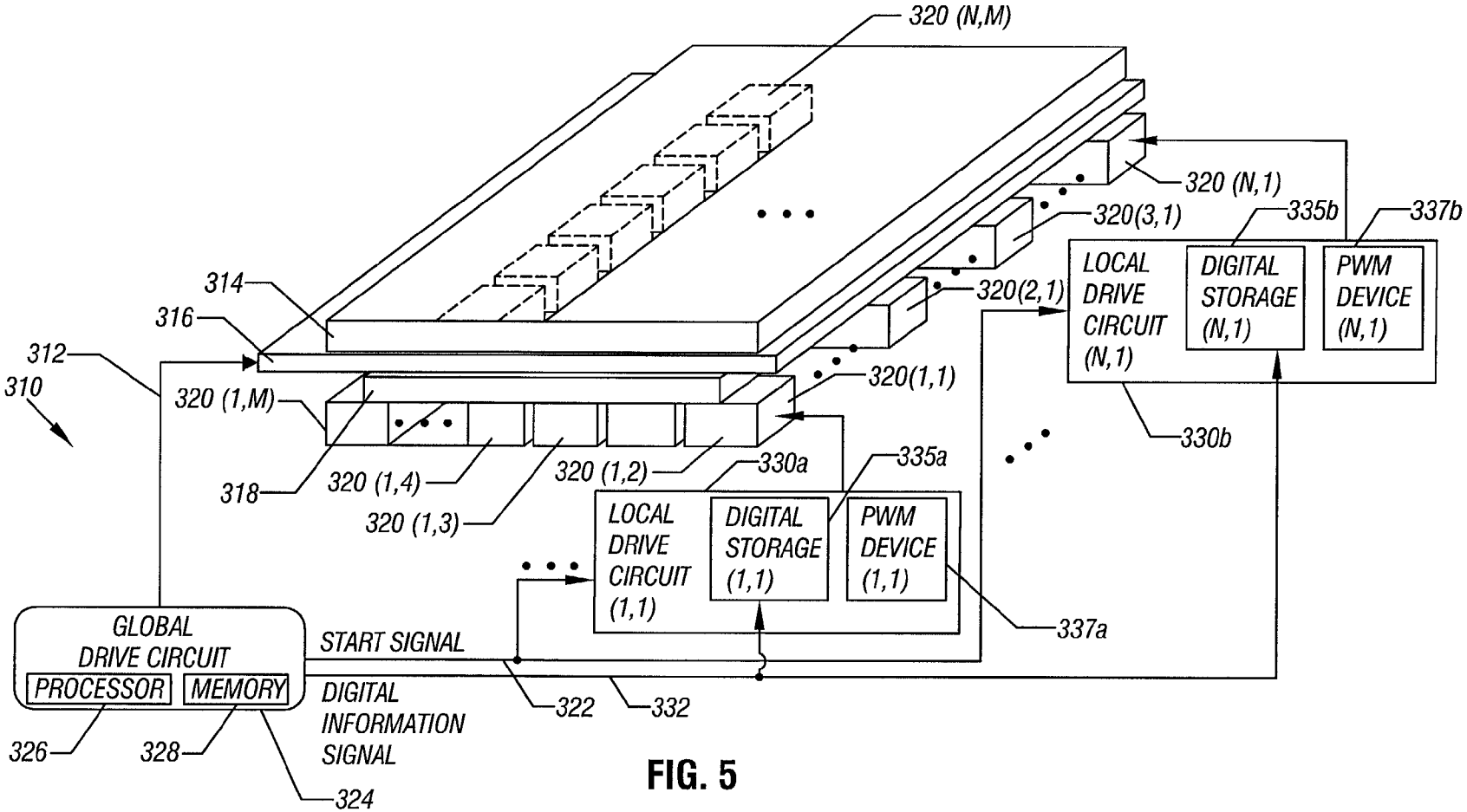
FIG. 5 is a schematic depiction of a display system based on the pixel architecture of FIG. 1 according to an embodiment of the present invention.

A display system 310 (e.g., a liquid crystal display (display), such as a spatial light modulator (SLM)) shown in FIG. 5 includes a liquid crystal layer 318 according to an embodiment of the present invention. In one embodiment, the liquid crystal layer 318 may be sandwiched between a transparent top plate 316 and a plurality of pixel electrodes 320(1, 1) through 320(N, M), forming a pixel array comprising a plurality of display elements (e.g., pixels). In some embodiments, the top plate 316 may be made of a transparent conducting layer, such as indium tin oxide (ITO).

Applying voltages across the liquid crystal layer 318 through the top plate 316 and the plurality of pixel electrodes 320(1, 1) through 320(N, M) enables driving of the liquid crystal layer 318 to produce different levels of intensity on the optical outputs at the plurality of display elements, i.e., pixels, allowing the display on the display system 310 to be altered. A glass layer 314 may be applied over the top plate 316. In one embodiment, the top plate 316 may be fabricated directly onto the glass layer 314. A global drive circuit 324 may include a processor 326 to drive the display system 310 and a memory 328 storing digital information including global digital information indicative of a common reference and local digital information indicative of an optical output from at least one display element, i.e., pixel.

In some embodiments, the global drive circuit 324 applies bias potentials 312 to the top plate 316. Additionally, the global drive circuit 324 provides a start signal 322 and a digital information signal 332 to a plurality of local drive circuits (1, 1) 330*a* through (N, 1) 330*b*, each local drive circuit may be associated with a different display element being formed by the corresponding pixel electrode of the plurality of pixel electrodes 320(1, 1) through 320(N, 1), respectively.

One technique in accordance with an embodiment of the present invention involves controllably driving the display system 310 using pulse-width modulation (PWM). More particularly, for driving the plurality of pixel electrodes 320(1, 1) through 320(N, M), each display element may be coupled to a different local drive circuit of the plurality of local drive circuits (1, 1) 330*a* through (N, 1) 330*b*, as an example. To hold and/or store any digital information intended for a particular display element, a plurality of digital storage (1, 1) 335*a* through (N, 1) 335*b* may be provided, each digital storage may be associated with a different local drive circuit of the plurality of local drive circuits (1, 1) 330*a* through (N, 1) 330*b*, for example.

Likewise, for generating a single-edged PWM waveform based on the respective digital information, a plurality of PWM devices (1, 1) 337*a* through (N, 1) 337*b* may be provided in order to drive a corresponding display element. In one case, each PWM device of the plurality of PWM devices (1, 1) 337*a* through (N, 1) 337*b* may be associated with a different local drive circuit of the plurality of local drive circuits (1, 1) 330*a* through (N, 1) 330*b*.

Consistent with one embodiment of the present invention, the global drive circuit 324 may receive video data input and may scan the pixel array in a row-by-row manner to drive each pixel electrode of the plurality of pixel electrodes 320(1, 1) through 320(N, M). Of course, the display system 310 may comprise any desired arrangement of one or more display elements. Examples of the display elements include spatial light modulator devices, emissive display elements, non-emissive display elements and current and/or voltage driven display elements.

One embodiment of the display system 310 may be based on a digital system architecture that uses pulse-width modulation to produce color in spatial light modulator devices arranged in a matrix array comprising a plurality of digital pixels, each digital pixel including one or more sub-pixels. In one case, the matrix array may include a plurality of columns and a plurality of rows. The columns and rows may be driven by a separate global drive circuit, which may enable localized generation of a single-edged PWM voltage or current waveforms at a digital pixel level to drive the plurality of digital pixels. Alternatively, the plurality of digital pixels may be configured in any other useful or desirable arrangement.

In one embodiment, the present invention generates a single-edged PWM waveform that include at least one of the following three features. First, the pixels work with a display system architecture that generates a single "ON" pulse. Such display systems allow for better control of the LC material. Second, the serial comparison allows for less wiring density and smaller under-pixel hardware. Finally, the partitioning of functionality between the global system and local pixel is novel.

Several advantages may be derived in one embodiment. For example, by supporting a system architecture that generates a single "ON" pulse, the device can better control the LC material. This control may be lacking in some situations with approaches that add up multiple non-overlapping pulses to build the PWM waveform. Accordingly, the pixel hardware may be advantageously simplified to allow small sizes. This scheme may allow a duty cycle to vary as a linear function of pixel value with a single "ON" pulse. In this way, PWM may enable digital pixel architectures for SLM devices to design a digital SLM.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A method, comprising:

receiving at a first display element first digital data indicative of an optical output from the first display element;

receiving at the first display element second digital data indicative of a common reference with respect to a second display element; and generating for said first display element a modulated signal including one transition separating a first pulse interval from a second pulse interval based on said first and second digital data.

2. The method of claim 1, including:

comparing said first digital data to said second digital data to provide an indication of a comparison between said first and second digital data; and driving the first display element from the modulated signal to provide the optical output based on said comparison.

3. The method of claim 2, including deriving said one transition to form the modulated signal within a refresh period based on said indication.

4. The method of claim 3, including illuminating the first display element for a duration within said refresh period based on said one transition.

5. The method of claim 2, further including asserting a first signal to:

start a frame within said refresh period; and set the modulated signal to an "ON" logic state at the beginning of said frame.

6. The method of claim 5, including asserting a second signal to:

selectively load said first digital data at the first display element; and dynamically update said second digital data.

7. The method of claim 6, including providing a third signal based on said indication from the comparison causing said one transition from said "ON" logic state to said "OFF" logic state when said first and second digital data are substantially equal.

8. The method of claim 6, including providing a fourth signal based on said indication from the comparison causing said one transition from said "OFF" logic state to said "ON" logic state when said first and second digital data are different.

9. The method of claim 1, further including:

receiving said first digital data including a current pixel value in at least one register associated with the first display element in parallel;

receiving said second digital data including a current count value at the first display element in parallel; and performing pulse width modulation based on a parallel comparison of said current pixel value and said current count value to indicate said one transition.

10. The method of claim 1, further including:

serially receiving said first digital data including a current pixel value in at least one register associated with the first display element;

serially receiving said second digital data including a current count value at the first display element; and performing pulse width modulation based on a serial comparison of said current pixel value and said current count value to indicate said one transition.

11. An apparatus, comprising:

a first display element; and a waveform generator operably coupled to the first display element to receive at the first display element first digital data indicative of an optical output from the first display element and second digital data indicative of a common reference with respect to a second display element to generate for said first display element a modulated signal including one transition separating a first pulse interval from a second pulse interval based on said first and second digital data.

12. The apparatus of claim 11, wherein said waveform generator to:

compare said first digital data to said second digital data to provide an indication of a comparison between said first and second digital data; and drive the first display element from the modulated signal to provide the optical output based on said comparison.

13. The apparatus of claim 12, further comprising:

a storage device operably coupled to the waveform generator to receive said first digital data, wherein said waveform generator to:

derive said one transition to form the modulated signal within a refresh period based on said indication; and illuminate the first display element for a duration within said refresh period based on said one transition.

14. The apparatus of claim 13, wherein said waveform generator to receive:

a first signal to start a frame within said refresh period and set the modulated signal to an "ON" logic state at the beginning of said frame; and a second signal to selectively load said first digital data at the first display element and dynamically update said second digital data.

15. The apparatus of claim 13, wherein the first display element includes a plurality of display elements forming an array of display elements in a liquid crystal display.

16. The apparatus of claim 15, wherein said liquid crystal display includes a spatial light modulator.

17. The apparatus of claim 13, wherein said waveform generator to receive:

a third signal based on said indication from the comparison causing said one transition from said "ON" logic state to said "OFF" logic state when said first and second digital data are substantially equal; and a fourth signal based on said indication from the comparison causing said one transition from said "OFF" logic state to said "ON" logic state when said first and second digital data are different.

18. The apparatus of claim 17, wherein said waveform generator includes a comparator to compare said first digital data with said second digital data to provide said one transition in the modulated signal driving the first display element.

19. The apparatus of claim 18, wherein said waveform generator includes:

a first bus to receive said first digital data including a current pixel value in at least one register associated with the first display element in parallel;

a second bus to receive said second digital data including a current count value at the first display element in parallel; and pulse width modulation circuitry to form said modulated signal based on said one transition in parallel, said pulse width modulation circuitry to perform pulse width modulation based on a parallel comparison of said current pixel value and said current count value to indicate said one transition.

20. The apparatus of claim 18, wherein said waveform generator includes:

a first port to serially receive said first digital data including a current pixel value in at least one register associated with the first display element;

a second port to serially receive said second digital data including a current count value at the first display element; and pulse width modulation circuitry to serially form said modulated signal based on said one transition, said pulse width modulation circuitry to perform pulse width modulation based on a serial comparison of said current pixel value and said current count value to indicate said one transition.

21. A processor-based system, comprising:

a plurality of pixel cells forming a pixel array; and a plurality of drive circuits each drive circuit associated with a different pixel cell of the pixel array to receive first digital data indicative of an optical output from said different pixel cell and receive second digital data indicative of a common reference for said plurality of pixel cells to generate for said different pixel cell a modulated signal including one transition separating a first pulse interval from a second pulse interval based on said first and second digital data.

22. The processor-based system of claim 21, wherein said each drive circuit comprising:

a waveform forming device to generate the modulated signal through pulse width modulation that drives said different pixel cell of the pixel array causing the optical output based on said first and second digital data associated with said different pixel cell of the pixel array.

23. The processor-based system of claim 22, wherein said each drive circuit further comprising a digital storage device operably coupled to the waveform forming device to receive said first and second digital data associated with said different pixel cell of the pixel array, wherein said each drive circuit to:

compare said first digital data to said second digital data to provide an indication of a comparison between said first and second digital data;

drive the first display element from the modulated signal to provide the optical output based on said comparison;

derive said one transition to form the modulated signal within a refresh period based on said indication; and illuminate the first display element for a duration within said refresh period based on said one transition.

24. The processor-based system of claim 23, wherein said each digital storage device to dynamically receive corresponding said first and second digital data associated with said different pixel cell to cause a duration of illumination for said different pixel cell of the pixel array based on the length of the first pulse interval of the modulated signal within said refresh period.

25. The processor-based system of claim 23, wherein said pixel array includes a liquid crystal display.

26. The processor-based system of claim 25, wherein said liquid crystal display includes a spatial light modulator.

27. The processor-based system of claim 23, wherein said each drive circuit to receive:

a first signal to start a frame within said refresh period and set the modulated signal to an "ON" logic state at the beginning of said frame; and a second signal to selectively load said first digital data at the first display element and dynamically update said second digital data.

28. The processor-based system of claim 27, wherein said each drive circuit includes a comparator to compare corresponding said first digital data with said second digital data to provide said one transition in the modulated signal for said different pixel cell of said pixel array.

29. The processor-based system of claim 28, wherein said each drive circuit to receive:

a third signal based on said indication from the comparison causing said one transition from said "ON" logic state to said "OFF" logic state when said first and second digital data are substantially equal; and a fourth signal based on said indication from the comparison causing said one transition from said "OFF" logic state to said "ON" logic state when said first and second digital data are different.

30. The processor-based system of claim 23, wherein said each digital storage device includes at least one register to store corresponding said first and second digital data associated with said different pixel cell.

* * * * *